United States Patent [19]

Harrold

[11] 4,430,939

[45] Feb. 14, 1984

[54] LINEAR SHAPED CHARGES

[76] Inventor: Gordon Harrold, c/o QED Design & Development Ltd., Borough Green, Kent, England

[21] Appl. No.: 323,129

[22] Filed: Nov. 19, 1981

[30] Foreign Application Priority Data

Nov. 19, 1980 [GB] United Kingdom ..... 8037093

[51] Int. Cl.[3] ..... F42B 1/02

[52] U.S. Cl. ..... 102/307; 102/308; 102/310; 102/476; 89/1 B

[58] Field of Search ..... 102/306-310, 102/275.1-275.12, 377, 378, 476, 518, 519, 701; 89/1 B

[56] References Cited

U.S. PATENT DOCUMENTS

| | | | |
|---|---|---|---|
| 2,113,004 | 4/1938 | Snelling | 102/275.8 |
| 2,877,708 | 3/1979 | Rey | 102/275.8 |
| 3,311,055 | 3/1967 | Stresau, Jr. et al. | 102/701 X |
| 3,320,883 | 5/1967 | Welsh | 102/275.8 |
| 3,336,868 | 8/1967 | Rush et al. | 102/307 X |
| 3,375,108 | 3/1968 | Wyman, Sr. et al. | 102/306 X |
| 3,698,281 | 10/1972 | Brandt et al. | 89/1 B |
| 3,830,156 | 8/1974 | Sewell et al. . | |
| 3,919,939 | 11/1975 | Murray et al. | 89/1 B X |
| 3,970,006 | 7/1976 | Copeland et al. | 89/1 B |
| 3,971,290 | 7/1976 | Blain | 89/1 B |

FOREIGN PATENT DOCUMENTS

| | | |
|---|---|---|
| 2135551 | 2/1973 | Fed. Rep. of Germany . |
| 2067874 | 7/1971 | France . |

OTHER PUBLICATIONS

Jetcord Brochure, Explosive Technology Co., Fairfield, Calif.

*Primary Examiner*—Peter A. Nelson
*Attorney, Agent, or Firm*—Bacon & Thomas

[57] ABSTRACT

A linear shaped charge has a v-shaped indentation cladded with e.g. lead. The explosive body is formed of discrete explosive elements, such as detonator cords, at least one of which is positioned along the apex of the indentation so that detonation can be initiated in that region.

7 Claims, 3 Drawing Figures

LINEAR SHAPED CHARGES

Figure 1:
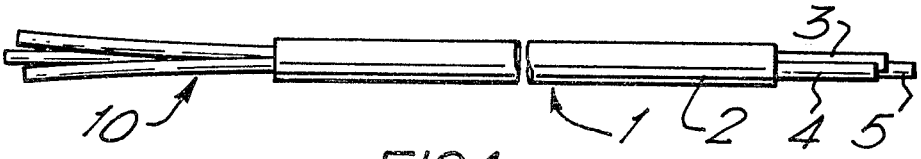

This invention relates to linear shaped charges. Such charges generally consist of an explosive column clad in a metallic sheath with a cross-section designed to take advantage of the Munroe effect. That effect is caused by the interaction of the detonation products and the sheath material emanating at high velocity from the shaped charge as the explosive detonates. A high energy jet of detonation products is obtained, which can be used to penetrate e.g. metal plate. Linear shaped charges of this type are particularly useful for demolition purposes and greatly more efficient than e.g. hand formed strips of plastic explosive.

A known linear shaped charge has a chevron cross-section and in general to take advantage of the Munroe effect there must be a substantially V-shaped indentation into the body of explosive which is clad with a suitable material such as a metal.

According to invention there is provided a linear shaped charge comprising an elongate explosive body having a longitudinally extending indentation therein of substantially V-shaped cross section which indentation is provided with a cladding material, wherein the explosive body comprises a plurality of elongate explosive elements one of which is positioned adjacent the apex of the indentation and is separated from the remainder of the explosive body.

By this means it is possible to detonate at the apex of the indentation, which is considerably more efficient than detonating the entire explosive body as is done with existing linear charges.

The separation of the element adjacent the apex from the remainder of the explosive body can be achieved in a number of ways. For example dividers of e.g. plastics could be used although care should be taken not to use a divider of for example a metal which would interfere with the Munroe effect. It might be possible to manufacture the shaped charge by extruding a plastics body with a number of channels through it which can be filled with explosive. A complete metal sheath—or at least a cladding for the indentation—will be provided.

Conventional methods of manufacturing shaped linear charges involve the handling of explosive in bulk. For example a tube of metal may be filled with molten explosive and subsequently deformed to give the chevron shape. Alternatively a large, thick slab may be rolled down to the required shape.

In accordance with the present invention it is possible to manufacture the shaped linear charge using entirely pre-fabricated elongate explosive elements. Thus for example three such elements could be placed in a sheath of e.g. lead which would then be deformed finally to give the required shape. The use of prefabricated elements considerably reduces handling difficulties at the manufacturing stage, avoids the necessity of substantially moulding explosive and reduces expense.

A suitable explosive element has been found to be commercially available detonating cord. Such a cord may for example comprise an explosive core of e.g. PETN, around which is fibre packing and then a plastics sheath. It will be appreciated that even if two such cords are in contact their explosive cores will be separated. It has further been found that if for example three cords are used, two being at the ends of the legs of a chevron, the explosive cores of those two are naturally spaced from the ends of the legs. It is sometimes desirable in the use of shaped linear charges to use spacers to hold the charge away from the surface to be penetrated; with a construction as mentioned above the explosive cores are automatically spaced from the ends of the Chevron legs—and thus from a surface to be penetrated. This may reduce or eliminate the need for spacers in certain circumstances.

With conventional linear shaped charges using moulded explosive, if it is desired to increase the strength of the charge, more explosive is used and a larger Chevron is required. By using commercially available detonating cords of different strength, in a charge in accordance with the present invention, it is possible to vary the explosive charge without altering the external size of the chevron. This enables easy and inexpensive selection of charge size for any particular application.

The number of variations possible will depend on the number of cords used—for example three or five. The charge should be balanced.

Figure 2:
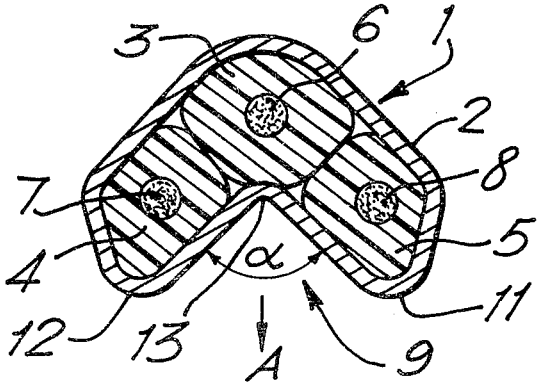
Figure 3A:
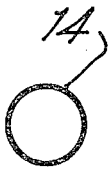
Figure 3B:
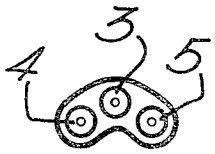
Figure 3C:
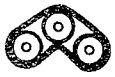
Figure 3D:
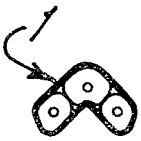

An embodiment of the invention will now be described by way of example and with reference to the accompanying drawings, in which FIG. 1 is a perspective view of a linear shaped charge in accordance with the invention;

FIG. 2 is a cross section through the charge of FIG. 1.

FIGS. *3a*, *3b*, *3c* and *3d* show various stages in the manufacture of a shaped charge in accordance with the invention.

As shown in FIGS. 1 and 2, shaped linear charge 1 comprises a metallic sheath 2, for example of lead although other metals could be used,—in which are positioned three detonator cords 3, 4 and 5. These are commercially available cords having a PETN explosive core 6, 7 and 8 respectively, in a plastic sheath.

The charge is of chevron cross section, with a V-shaped indentation 9 having an angle $\alpha$ of 90°. The charge can be of any suitable length, 2 meters being standard. A 150 mm length 10 of the cords 3, 4 and 5 projects from one end of the charge for handling and detonation purposes. As the explosive is in powder form, the ends of the cords are sealed.

The cord 3 is positioned along the apex of the indentation 9 and it is inherent in the construction that the explosive core 6 of this cord is separated from those, 7 and 8, of the other cords.

In use, the charge 1 is placed on a surface to be penetrated, the portions 11 and 12 resting on the surface. Spacers could be used if necessary, although it may be possible to dispense with them since explosive cores 7 and 8 are spaced from portions 11 and 12. A detonator is attached to the end of cord 3 in region 10. Detonation is then initiated along the apex 13 of the indentation 9. The remaining cords detonate automatically a few microseconds later. There is produced an efficient jet in the direction of the arrow A on FIG. 2.

With reference now to FIGS. *3a* to *3d*, one preferred method of manufacture is shown. A tube 14 of lead is used as the starting point in FIG. *3a*. This is then deformed somewhat to an approximate kidney shape and the three detonating cords 3, 4 and 5 inserted, to give the arrangement shown in FIG. *3b*. The entire structure is then rolled to give the chevron shape in FIG. *3c*. Finally, it is rolled to a tighter size to grip and support the detonator cords, to give the final shape and produce the charge 1 as shown in FIG. *3d* and in more detail in FIG. 2. The cross-sections of the cords 3, 4 and 5 naturally become distorted somewhat in this arrangement.

The complete charge is somewhat malleable—as with known linear charges—to enable it to be moulded to follow required shapes in use.

Although the invention has been described with specific regard to linear shaped charges it is conceivable that the concept of apex detonation could be applied to other shaped charges.

I claim:

1. A linear shaped charge comprising an elongate explosive body having a longitudinally extending indentation therein of substantially V-shaped cross section which indentation is provided with a cladding material, wherein the explosive body comprises a plurality of elongate explosive elements, one of which is positioned above and adjacent the apex of the indentation and is separated from the remainder of the explosive body, and means are provided for initiating detonation of the explosive body in said one element.

2. A charge as claimed in claim 1, wherein a divider is provided to separate the elements adjacent the apex from the remainder of the explosive body.

3. A charge as claimed in claim 1, wherein the explosive elements are pre-fabricated.

4. A charge as claimed in claim 3 wherein the explosive elements comprise detonator cords.

5. A charge as claimed in claim 1 comprising at least three explosive elements, one positioned adjacent the apex of the indentation and two positioned adjacent the legs of the indentation.

6. A charge as claimed in claim 5 wherein said two explosive elements are spaced from the ends of the legs of the indentation.

7. A charge as claimed in claim 1 wherein the detonation initiating means comprises a detonator connected to said one element.

* * * * *